United States Patent [19]

Kliger et al.

[11] Patent Number: 4,898,340

[45] Date of Patent: Feb. 6, 1990

[54] APPARATUS AND METHOD FOR CONTROLLING A CANNON-LAUNCHED PROJECTILE

[75] Inventors: Isaac E. Kliger, Lexington; Richard A. Beckerleg, Boxford, both of Mass.

[73] Assignee: Raytheon Company, Lexington, Mass.

[21] Appl. No.: 339,535

[22] Filed: Jan. 15, 1982

[51] Int. Cl.[4] ..... F41G 7/00

[52] U.S. Cl. ..... 244/3.11; 244/3.21; 244/3.13

[58] Field of Search ..... 244/3.13, 3.21, 3.22, 244/3.11

[56] References Cited

U.S. PATENT DOCUMENTS

| | | | |
|---|---|---|---|
| 3,028,807 | 4/1962 | Burton et al. | 244/3.13 |
| 3,374,967 | 3/1968 | Plumley | 244/3.22 |
| 3,758,052 | 9/1973 | McAlexandor et al. | 244/3.22 |
| 3,860,199 | 1/1975 | Dunne | 244/3.13 |
| 4,300,736 | 11/1981 | Miles | 244/3.13 |

*Primary Examiner*—Charles T. Jordan

*Attorney, Agent, or Firm*—Philip J. McFarland; Richard M. Sharkansky

[57] ABSTRACT

A control system for a cannon-launched projectile carrying explosive squibs is shown to comprise: (a) a first control computer, responsive to the range and bearing of a selected ground target, to compute an ideal ballistic trajectory between an artillery piece and such target and to calculate the line of sight between the artillery piece and points on such trajectory; (b) an infrared beam generator and scanner for scanning, under the control of a first clock, such beam in a predetermined pattern centered on the calculated line of sight; (c) a sensor carried on the cannon-launched projectile for detecting when the infrared beam irradiates such projectile; a second clock on the cannon-launched projectile operating synchronously with the first clock to indicate the position of the infrared beam when the cannon-launched projectile is irradiated; and (d), a firing controller for selecting and firing one, or more, explosive squibs to force the cannon-launched projectile toward the ideal ballistic trajectory.

5 Claims, 2 Drawing Sheets

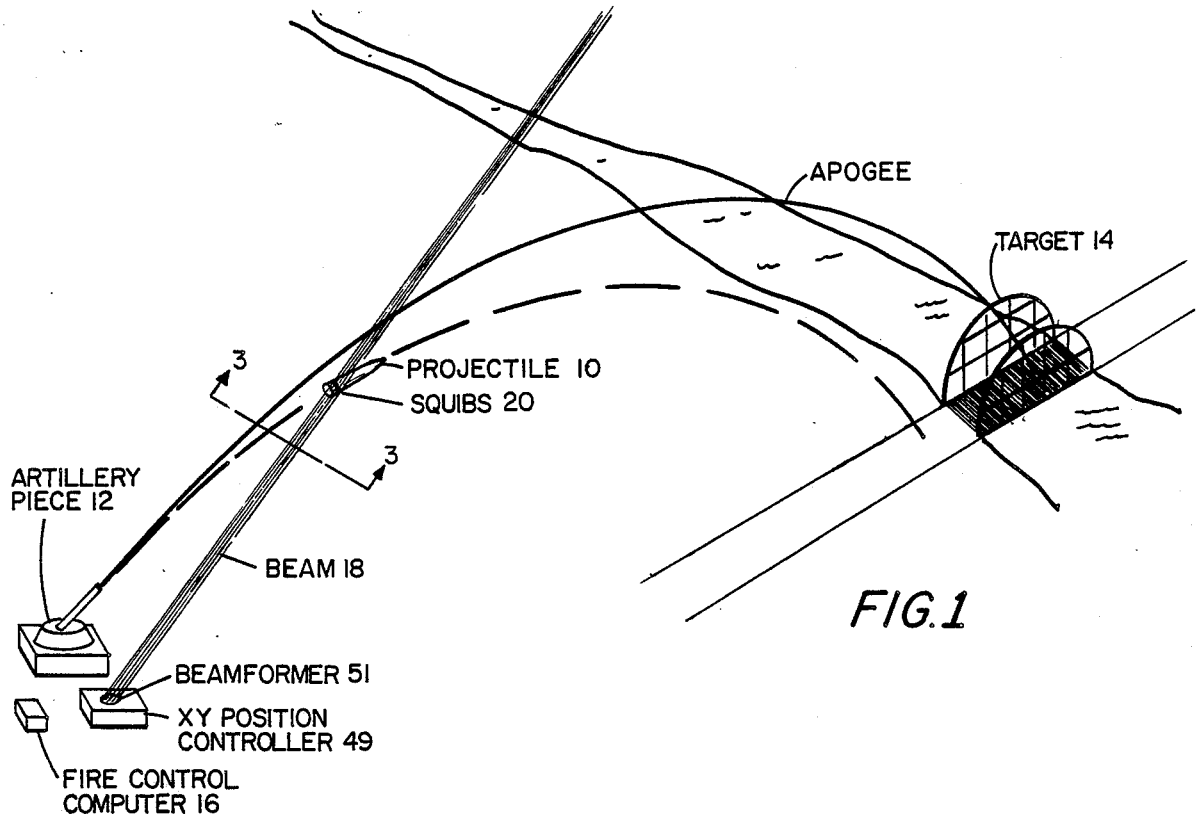
FIG. 1
FIG. 3
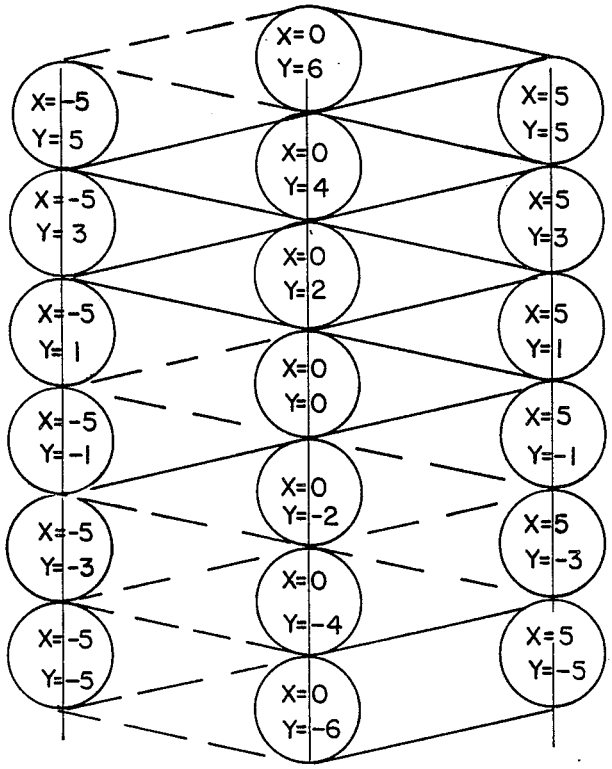

APPARATUS AND METHOD FOR CONTROLLING A CANNON-LAUNCHED PROJECTILE

BACKGROUND OF THE INVENTION

This invention pertains generally to fire control systems, and particularly to systems of such type whereby the trajectory of a cannon-launched projectile is controlled during flight.

It has been proposed that a so-called "beam-riding" technique be used to control the flight path of a cannon-launched projectile such as an artillery shell. Thus, in the system described in U.S. Pat. No. 4,300,736 (assigned to the same assignee as the present application), the relative rotational motion between a modulated beam of infrared (IR) energy and a spinning projectile is used to determine, during flight, the displacement of such a projectile from the center-line of such beam so that the trajectory of the projectile may be corrected as required to enable a selected target to be hit. Unfortunately, however, due to atmospheric disturbances as, for example, fog or smoke, the modulated beam and its spatial pattern may become distorted, or diffused, with the result that proper location of the projectile at the center of the beam is difficult to achieve. Furthermore, because of the uncertainty in the initial position of the projectile (such uncertainty being due to the ballistic dispersion of the cannon) a relatively broad beam must be transmitted.

SUMMARY OF THE INVENTION

With the foregoing background of the invention in mind, it is a primary object of this invention to provide an improved beam-riding system for guiding cannon-launched projectiles.

Another object of this invention is to provide an improved beam rider system wherein an unmodulated narrow beam is scanned through space in synchronism with a clock on board cannon-launched projectiles.

The foregoing and other objects of this invention are generally attained by providing an illuminator for generating a divergent beam of IR energy, the position of such beam in space relative to the ideal ballistic trajectory between an artillery piece and a selected target being measurable by equipment on a cannon launched projectile in flight so that the actual trajectory of such projectile may be corrected to correspond with the ideal ballistic trajectory. To effect the desired object, the illuminator is mounted within a housing positionable by a two-axis (X-Y) position controller which, in turn, is controlled by a pair of counters driven by a clock. A cannon-launched projectile is also equipped with a pair of counters synchronized to the counters in the beam controller. Whenever the IR energy in the beam is detected at the projectile, the projectile counters are read to establish the angular position of the projectile with respect to a selected point (say the apogee) along the ideal ballistic trajectory.

BRIEF DESCRIPTION OF THE DRAWINGS

For a more complete understanding of this invention, reference is now made to the following description of the accompanying drawings wherein:

FIG. 1 is a sketch illustrating an exemplary tactical situation in which the invention may be used for indirect fire;

FIG. 3 is a sketch illustrating a beam scanning pattern resulting from the beam steering arrangement shown in FIG. 2.

DESCRIPTION OF THE PREFERRED EMBODIMENT

Figure 2:
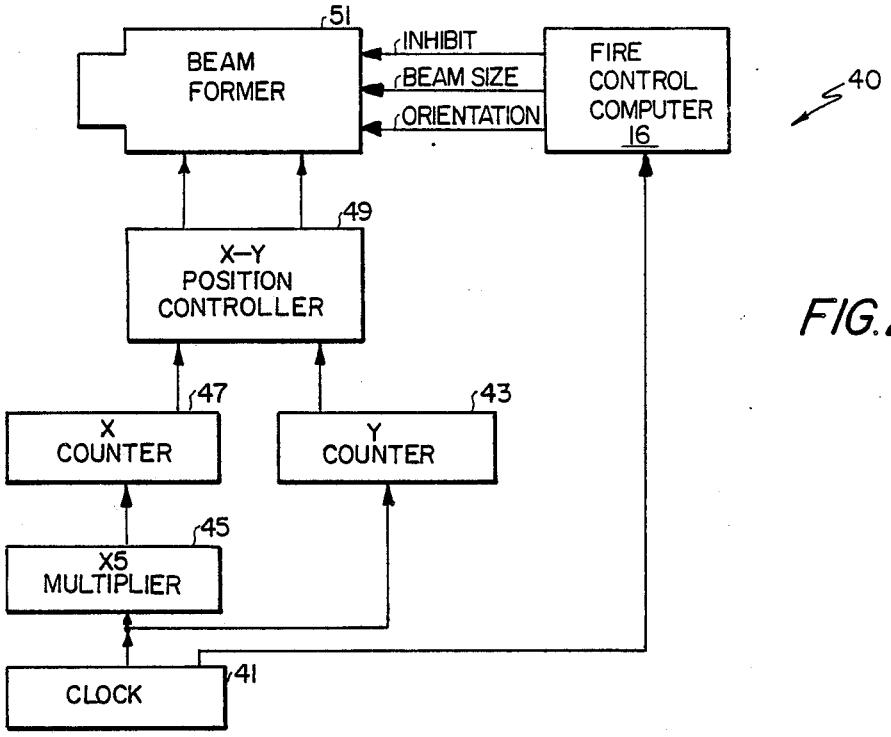
FIG. 2 is a simplified block diagram of a beam steering arrangement in accordance with this invention.

Referring now to FIG. 1, the illustrated tactical situation is seen to be one in which a cannon-launched projectile 10 (sometimes referred to as the projectile 10) is in flight from an artillery piece 12 toward a target 14, here a bridge. A conventional fire control computer 16, in response to range and bearing information derived in any known manner, is operated to produce aiming command signals, i.e., the initial elevation and azimuth angles for pointing, along with firing command, for the artillery piece 12. In addition to the aiming commands, the true (or ideal) trajectory (shown in full line) of the projectile 10 is calculated. A narrow beam of IR energy (hereinafter sometimes referred to as the beam 18) then is scanned (here in a manner to be described in connection with FIG. 3) so that the center of the scan pattern coincides, as the projectile 10 moves along its actual trajectory, with the true trajectory. As indicated in FIG. 1, the actual trajectory (shown in broken line) of the projectile 10 differs from the true trajectory because of dispersion, anomalies in the air or other sources of ballistic error. A number of explosive squibs 20 here is arranged around the periphery of the projectile 10. As is well known, the actual trajectory of the projectile 10 may be caused to coincide with the ideal trajectory by firing an appropriate one, or ones, of the explosive squibs 20 at an appropriate moment, or moments, of time.

Referring now to FIG. 2, beam scanning mechanism 40 as contemplated here is shown to include a synchronous clock 41 with its output signal split, with one portion being passed directly to a counter 43 (hereinafter referred to as Y counter 43) and a second portion being passed, via a frequency multiplier 45 (here multiplying by a factor of 5) to a second counter 47 (hereinafter referred to as X counter 47). The X counter 47 and the Y counter 43 are conventional "up-down" counters. The output signals from the X counter 47 and Y counter 43 are passed to a two axis gimbal system (hereinafter referred to as X-Y position controller 49) on which a beamformer 51 is mounted. Each output signal from the X and Y counters 47, 43 is effective to cause the X-Y position controller 49 to move the beamformer 51 so that beam 18 is scanned, as shown in FIG. 3, about the true trajectory of the projectile 10 (FIG. 1). The beamformer 51 is similar to that described in U.S. Pat. No. 4,300,736, with the exception that the beamforming mechanism described in the cited patent here includes a variable aperture stop to change the diameter of the beam 18 in response to an input signal from the fire control computer 16. The just-mentioned input signal is calculated in any convenient way to compensate for the range from the artillery piece 12 to the projectile 10 to ensure illumination of the projectile 10 at some time during each scan pattern of the beam 18.

As mentioned hereinabove, the beam 18 (FIG. 1) is scanned by reason of movement of the X-Y position controller 49 in response to signals from counters 47, 43.

The X-Y position controller 49 is initialized when the counts out of the counters 47, 43 are at X=0 and Y=0 (which here corresponds to the position of the beam 18 (FIG. 1) when pointed at the apogee of the true trajectory. Because the X counter 47 counts at a rate five times that of the Y counter 43, the resulting beam scan pattern is as illustrated in FIG. 3. As may be seen, while there is some overlap between various beam positions, there are no voids in the scan pattern. It may also be seen that the beam 18 is scanned at a constant slope as opposed to being stepped whenever the output of the Y counter 43 corresponds to a whole number.

It should be noted in passing that the clock 41 also provides an input signal to the fire control computer 16 wherein the expected (or computed) time for the projectile 10 to reach the apogee of its true trajectory is computed. When the elapsed time (determined by monitoring the clock signal) equals the computed time, the fire control computer 16 here provides an INHIBIT signal to the beamformer 51 to stop propagation of the beam 18 (FIG. 1). The projectile 10 then follows a ballistic trajectory to the target 14. It will be appreciated by those of skill in the art that for direct fire applications the projectile 10 would be guided all the way to impact.

Figure 4:
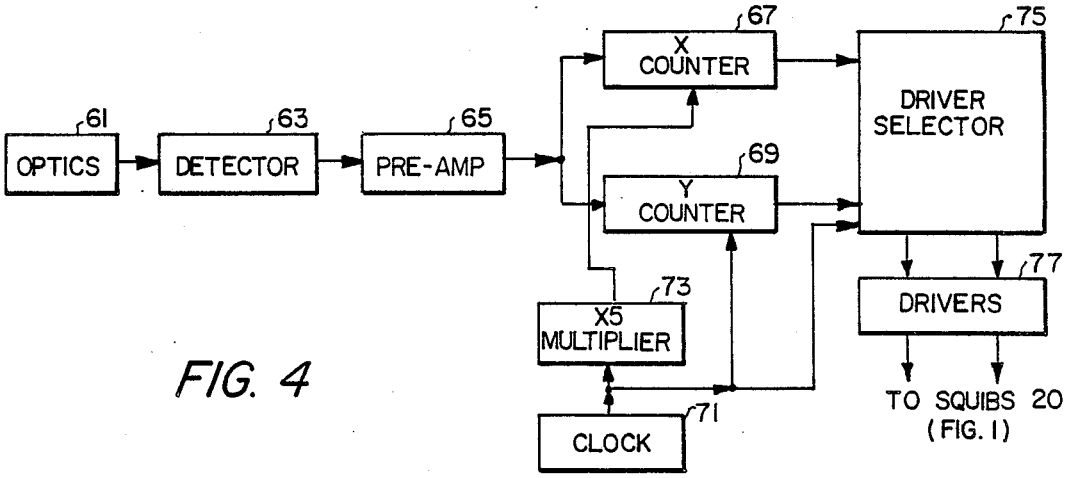
FIG. 4 is a simplified block diagram of electronic circuitry contemplated by this invention to be carried by a cannon-launched projectile.

Referring now to FIG. 4, it may be seen that the IR energy in the beam 18 (FIG. 1) falling on the projectile 10 is passed through a conventional optical arrangement (labeled optics 61) to be focused on an IR detector 63 (here a single element silicon P-I-N diode, type SGD-444, manufactured by EG&G, Inc., Wellesley, Mass.). The output signal from the IR detector 63 is amplified in a preamplifier 65 and then passed as a trigger signal to an X counter 67 and a Y counter 69. The Y counter 69 is driven by an output signal from a clock 71 and the X counter 67 is driven by the output of the clock 71 after multiplication by a factor of 5 in a frequency multiplier 73. The clock 71 is arranged to operate synchronously with the clock 41 (FIG. 2) which controls the beam steering mechanism 40 (FIG. 2). Whenever a trigger pulse (indicating that the beam 18 is illuminating the projectile 10) occurs the then existing count in X counter 67 and Y counter 69 is passed to a driver selector 75 wherein the present position of the projectile 10 (FIG. 1) relative to the center of the beam scan pattern is determined and an enable firing signal is produced if the determined position differs by a predetermined amount from the true trajectory.

It will now be observed that there are two possible modes of operation to determine the deviation of the projectile 10 from the ideal trajectory. In one mode, the center of the beam scan pattern, i.e. the intersection of the beam 18 (when X=0 and Y=0) with the ideal trajectory may be fixed. In the second mode the center of the beam scan pattern may be caused to move, at a velocity equal to that of the projectile 10, so that the intersection of the beam 18 (when X=0 and Y=0) and the ideal ballistic trajectory represents the position of a projectile moving without any deviation. In both modes, deviation in the X direction is (neglecting any parallax due to spacing between the artillery piece 12 and the beamformer 51) indicated by a count in the X counter 67 differing from zero. In the latter mode, deviation in the Y direction is indicated by a count in the Y counter 69 differing from zero. However, if operation is in the mode where the center of the beam scan pattern is fixed, the count in the Y counter 69 is not a direct indication of the deviation of the projectile 10. That is to say, were the projectile 10 assumed to be moving along the ideal ballistic trajectory, the count in the Y counter 69 would change from +5 through zero to −5 as the projectile 10 "flies through" the beam scan pattern. To determine deviation then, it is necessary that the actual count in the Y counter 69 be compared with an "ideal" count (meaning the count which would exist if the projectile 10 were on the ideal ballistic trajectory at the time the actual count occurs). Fortunately, with an a priori knowledge of the velocity of the projectile 10 and the ideal ballistic trajectory, the position of the projectile 10 following the ideal ballistic trajectory may be approximated by counting the clock pulses out of the clock 71 after firing. It follows then that the difference between the actual count and ideal count may be determined so that the deviation may be calculated.

Having determined that the deviation of the projectile 10 (FIG. 1) exceeds a predetermined value (meaning that the actual trajectory of the projectile 10 differs from the true trajectory of such projectile by more than a tolerable amount) along with the direction of such displacement from the center of the beam scan pattern, firing a particular one (or ones) of the squibs 20 (FIG. 1) will impart a thrust impulse through the center of gravity of the projectile 10 (FIG. 1) to move the actual trajectory into coincidence with the true trajectory. It will be obvious to one of skill in the art that the problem initially is simply to provide a firing signal to the first one of the squibs 20 (FIG. 1) to be positioned on the line defined by the center of the beam scan pattern and the projectile 10 (FIG. 1). Appropriate logic circuitry, say, for example, a circulating shift register having the same number of stages as squibs 20 (FIG. 1) and enabled when a correction should be made, is here provided in the driver selector 75 to allow the appropriate one of a like number of drivers 77 to be actuated.

Having described a preferred embodiment of the invention, it will now be apparent to one of skill in the art that many modifications may be made without departing from the disclosed concept. Thus, for example, small wings or control surfaces could be used to replace the squibs 20 to provide the requisite control of the projectile 10. It is felt, therefore, that this invention should not be restricted to its disclosed embodiment, but rather should be limited only by the spirit and scope of the appended claims.

What is claimed is:

1. In a system for controlling the flight of a cannon-launched projectile toward a selected target from an artillery piece, such system including a fire control computer for calculating the ideal ballistic trajectory of such projectile and a beam-forming arrangement for projecting a beam of infrared energy along the ideal ballistic trajectory from a point adjacent to the artillery piece, the improvement comprising:

(a) means for scanning the beam of infrared energy to form, in accordance with a predetermined program, a beam scan pattern and periodically to irradiate the cannon-launched projectile in flight toward the selected target;

(b) means on the cannon-launched projectile for detecting infrared energy in the beam to produce a first control signal whenever such projectile is irradiated;

(c) means on the cannon-launched projectile for reproducing the predetermined program synchronously with such program;

(d) means on the cannon-launched projectile, responsive to the first control signal and the reproduced predetermined program, for producing a second control signal indicative of the position of the cannon-launched projectile relative to the ideal ballistic trajectory; and (e) means on the cannon-launched projectile for nulling the distance between the indicated position of such projectile and the ideal ballistic trajectory.

2. The improvement as in claim 1 wherein the center of the beam scan pattern is moved along the ideal ballistic trajectory at the velocity of the cannon-launched projectile.

3. The improvement as in claim 1 wherein the center of the beam scan pattern is fixed at a selected point on the ideal ballistic trajectory.

4. The improvement as in claim 2 or claim 3 wherein the predetermined program and the reproduced program are generated by counters controlled by synchronous clocks.

5. A method of operating a fire control system for correcting the flight path of a cannon-launched projectile to null any deviation of such path from the ideal ballistic trajectory between an artillery piece and a selected target, such method comprising the steps of:

(a) calculating the ideal ballistic trajectory of a cannon-launched projectile between an artillery piece and a selected target;

scanning a beam of infrared energy to irradiate a volume intermediate the artillery piece and the selected target, such volume encompassing at least a portion of the ideal ballistic trajectory in accordance with a predetermined program so that the beam of infrared energy intersects the ideal ballistic trajectory at a known point thereon and the cannon-launched projectile is periodically illuminated to produce a control signal;

(c) synchronously reproducing the predetermined program on the cannon launched projectile;

(d) determining, from the control signal and the reproduced program, the deviation of the cannon-launched projectile from the ideal ballistic trajectory; and (e) changing the flight path of the cannon-launched projectile to null any deviation from the ideal ballistic trajectory.

* * * * *